US005107083A

United States Patent [19]

Yagi

[11] Patent Number: 5,107,083

[45] Date of Patent: Apr. 21, 1992

[54] RESILIENTLY DEFORMABLE PUSHBUTTON SWITCH HAVING A CONTACT MEMBER CARRYING A CONDUCTIVE MATERIAL

[75] Inventor: Masaru Yagi, Tsushima, Japan

[73] Assignee: Kitagawa Industries Co., Ltd., Japan

[21] Appl. No.: 644,260

[22] Filed: Jan. 22, 1991

[30] Foreign Application Priority Data

Feb. 2, 1990 [JP] Japan ..... 2-10011

[51] Int. Cl.[5] ..... H01H 3/00; H01H 1/06

[52] U.S. Cl. ..... 200/341; 200/275; 200/512; 200/530

[58] Field of Search ..... 200/512, 513, 517, 341, 200/342, 530, 534, 275, 520, 264, 245, 246, 247, 5 A, 248, 562, 508

[56] References Cited

U.S. PATENT DOCUMENTS 3,699,293 10/1972 Portugall ..... 200/345
4,618,744 10/1986 Pope ..... 200/5 A
5,011,728 4/1991 Imae et al. ..... 200/302.2

FOREIGN PATENT DOCUMENTS 1246159 7/1986 U.S.S.R. ..... 200/512
8600462 1/1986 World Int. Prop. O. ..... 200/513

*Primary Examiner*—Henry J. Recla
*Assistant Examiner*—David J. Walczak
*Attorney, Agent, or Firm*—Davis, Bujold & Streck

[57] ABSTRACT

A pushbutton switch comprising a main body and a contact member supported by thin radial flanges. The main body is integrally molded of synthetic resin and composed of a plurality of switch buttons with cavities and open bottoms, thin flexible portions provided in communication with the peripheries of the switch buttons, and a base plate provided in communication with the peripheries of the flexible portions for supporting the switch buttons via the flexible portions. The contact member is made of conductive material at least at its bottom and is inserted into the cavity of the switch button. The thin flanges project from the contact member and are pressed onto the inner surface of the switch button so as to support the contact member to be movable in the axial direction of the switch button. The thin flanges can absorb vibration generated when the switch button is pressed hard and prevent the contact member from vibrating and chattering. When the button switch is obliquely pressed, the relative angle between the contact member and the switch button is changed so that the contact member comes in perfect contact with the contact points. In addition, the manufacturing operation to insert the contact member into the cavity of the switch button is remarkably simple.

16 Claims, 2 Drawing Sheets

RESILIENTLY DEFORMABLE PUSHBUTTON SWITCH HAVING A CONTACT MEMBER CARRYING A CONDUCTIVE MATERIAL

BACKGROUND OF THE INVENTION

This invention relates to a pushbutton switch comprising a switch button having a contact member with conductivity and a base plate molded integrally with the switch button.

As a method to connect or disconnect two contact points provided on a board such as a printed-wiring board, a pushbutton switch is known which comprises a switch button having a conductive member at its bottom, and a base plate molded integrally with the switch button for supporting the switch button such that the switch button can be moved vertically. The pushbutton switch is placed on the board having the two contact points such that the conductive member is positioned opposite to the two contact points. The two contact points can be easily connected to or disconnected from each other using the pushbutton switch. The contact points are connected by pressing down the switch button and are disconnected by stopping the pressing of the switch button.

In such a pushbutton switch, when the switch button is obliquely pressed from the upper side, the conductive member and the contact points are insufficiently connected. To prevent this, the conductive member is made of elastic material such as silicone rubber, or alternatively a guide member is provided for guiding the movement of the switch button such that the switch button is not inclined by oblique pressing. Even so, such a pushbutton switch has a problem. Since the conductive member is directly attached to the switch button, vibration, which is transmitted from a fingertip or generated on the switch button when pushed hard, adversely affects the conductive member. When this happens, chattering may be caused, that is to say, the contact points are repeatedly connected to or disconnected from each other due to the vibration.

To solve the above problem, U.S. Pat. No. 3,699,293 proposes a key switch in which a conductive member is attached to a switch button via a spring such as coil spring. The vibration caused when the switch button is pushed is absorbed by the spring and the conductive member is securely pressed onto the contact points by the energization of the spring. However, since the energization of the spring is used to keep close contact between the conductive member and the contact points, such a key switch should be provided with a controlling member for controlling the movement of the conductive member such that the conductive member may not touch the contact points while the switch button is not pushed. In addition to the controlling member, a guide member is required to prevent insufficient contact between the conductive member and the contact points, which happens, for example, when the switch button is obliquely pushed and thus the conductive member moves away from the contact points. Consequently, such a pushbutton switch has a complicated structure and high productivity and durability cannot be attained.

SUMMARY OF THE INVENTION

The object of this invention is to provide a pushbutton switch with a simple structure that can effectively prevent chattering caused by vibration in a structure which is simple, easily manufactured, and durable in use.

Other objects and benefits of the invention will become apparent from the detailed description which follows hereinafter when taken in conjunction with the drawing figures which accompany it.

The foregoing object is achieved by this invention, which provides a pushbutton switch comprising a main body integrally molded from synthetic resin and having a switch button made of a pillar with a cavity inside and an opened bottom, a thin flexible portion provided in communication with the periphery of the bottom of the switch button, a base plate provided in communication with the periphery of the flexible portion for supporting the switch button via the flexible portion; a contact member made of conductive material at least at its bottom and placed in the cavity of the switch button; and thin flanges projecting from the contact member and being pressed onto the inner side wall of the switch button such that the contact member is supported to be deformable in the axial direction of the switch button.

In a pushbutton switch according to this invention constructed as stated above, the switch button, the flexible portion, and the base plate, which compose the main body, are integrally molded from synthetic resin. By pressing the top of the switch button, the switch button is moved downward due to the flexibility of the flexible portion. When pressing of the switch button is stopped, the switch button is moved upward to regain its original shape due to the elastic strain energy stored in the flexible portion. In the cavity of the switch button the contact member is supported to be movable in the axial direction of the switch button via the thin flanges. In operation, the base plate is placed on a board such as a printed-wiring board such that the contact member is positioned opposite to contact points on the board. By actuating the switch button as mentioned above, the contact points are connected or disconnected by the contact member.

Any vibration generated on the switch button is not transmitted to the contact member because the vibration is absorbed by the thin flanges having elasticity provided on the contact member. When the switch button is pushed obliquely, the thin flanges become deformed and the relative angle between the contact member and the switch button is changed. Thus, the bottom of the contact member is sure to abut the contact points.

BRIEF DESCRIPTION OF THE DRAWINGS

By way of example and to make the description clearer, reference is made to accompanying drawings in which.

DETAILED DESCRIPTION OF THE PREFERRED EMBODIMENT

Figure 1A:
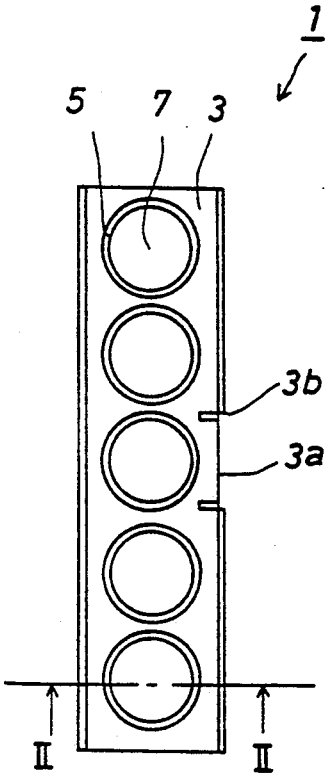
FIG. 1A is a plan view of a pushbutton switch embodying the present invention.
Figure 1B:
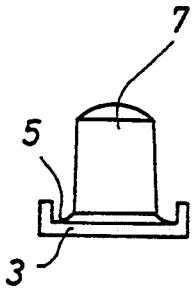
FIG. 1B is a front view of the pushbutton switch.

Set forth hereinafter is an explanation of an embodiment of the present invention with reference to the attached drawings in which, in particular, FIGS. 1A and 1B show a plan view and a front view of a pushbutton switch 1 of the embodiment, respectively.

A plurality of switch buttons 7 is successively provided on a base plate 3 via flexible portions 5. The switch buttons 7, the base plate 3, and the flexible portions 5 are integrally made of synthetic resin such as a thermoplastic elastomer.

A dent 3*a* is provided at the middle portion of one of the longitudinal side edges of the base plate 3. At both ends of the dent 3*a*, notches 3*b* are formed. When the pushbutton switch 1 is placed on a board such as a printed-wiring board, the dent 3*a* engages with a protrusion provided on a plastic case (not shown) for protecting the board. The pushbutton switch 1 is thus placed in a proper way. By cutting the pushbutton switch 1 along an extended line or lines of the notch or notches 3*b*, the pushbutton switch 1 can be divided into two or three parts having one, two, or three switch button(s) according to users' desires and needs. The pushbutton switch 1 could, of course, be made with any number of switch buttons 7 and the one of five switch buttons 7 as indicated is shown by way of example only.

Figure 2:
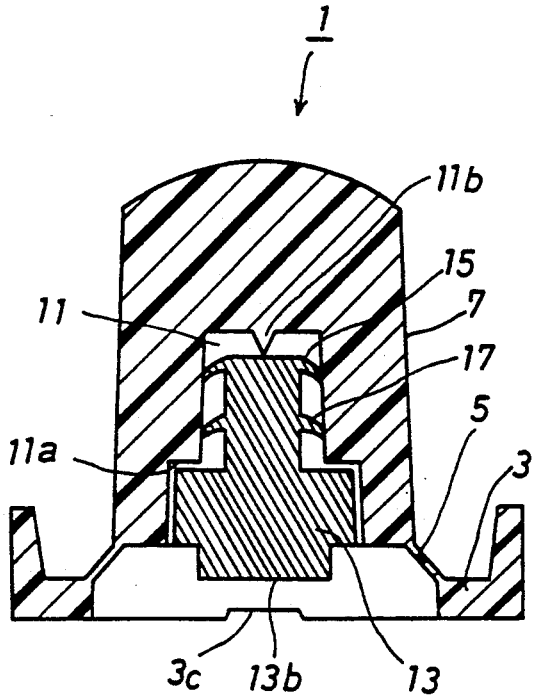
FIG. 2 is a cross-sectional view taken along the line II—II indicated in FIG. 1A.

As shown in FIG. 2 which is a cross-sectional view taken along the line II—II indicated in FIG. 1A, each of the switch buttons 7 comprises a pillar having a cylindrical cavity 11 with a bottom opening to the outside. In the cavity 11 a contact member 13 made of conductive material such as thermoplastic elastomer having conductivity is provided. The contact member 13 is used to connect or disconnect two contact points on a printed-wiring board or the like in the usual manner and, therefore, the contact points are not shown in the interest of simplicity. Communication holes 3*c* formed between the adjoining switch buttons 7 connect the cavities 11 of the switch buttons 7.

Figure 3:
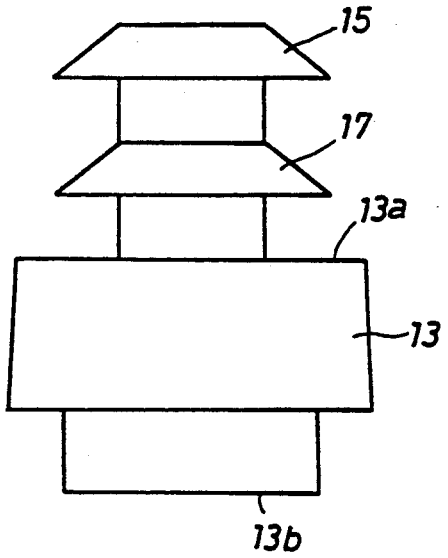
FIG. 3 is a front view of a contact member provided in a cavity of the pushbutton switch.

The contact member 13, as shown in FIGS. 2 and 3, is provided with two thin peripheral flanges 15 and 17 molded integrally with the contact member 13. When the contact member 13 is inserted in the cavity 11, the peripheral edges of the thin flanges 15 and 17 are pressed onto the inner side wall of the switch button 7. Thus, the contact member 13 is supported via the thin flanges 15 and 17 in the cavity 11 of the switch button 7 to be deformable in its axial direction.

A step 11*a* provided at substantially the middle portion of the inner side wall of the switch button 7 and a projection 11*b* provided at the ceiling of the cavity 11 keep the contact member 13 at an appropriate position in the cavity 11. The projection 11*b* is easily made when synthetic resin is filled in a die for the main body of the pushbutton switch 1 through the projection 11*b*. The contact member 13 has a shoulder 13*a* for abutting the step 11*a* in the inner surface of the switch button 7.

In the pushbutton switch 1 constructed as above, by pressing the switch button 7, the flexible portion 5 is deformed and the switch button 7 and the contact member 13 in the cavity 11 are moved down. When the pressing of the switch button 7 is stopped, the switch button 7 and the contact member 13 in the cavity 11 are moved back to their original positions due to elastic strain energy stored in the flexible portion 5. The pushbutton switch 1 is placed on the printed-wiring board such that a bottom face 13*b* of the contact member 13 is positioned opposite to the contact points on the printed-wiring board. When the switch button 7 is operated as mentioned above, the contact member 13 connects or disconnects the contact points.

During the operation of the switch button 7, the volume of the cavity 11 is being changed. The communication hole 3*c* formed between the adjoining switch buttons 7 allow air flow so that the cavity 11 does not create a partial vacuum and the switch buttons 7 do not stick to the printed-wiring board when the pressing of the switch button 7 is stopped.

In this embodiment, the contact member 13 is supported in the cavity 11 of the switch button 7 via the thin flanges 15 and 17. Since the thin flanges 15 and 17 are elastic, any vibration caused by pressing the switch button 7 is absorbed by the thin flanges 15 and 17. Further, when the switch button 7 is pushed obliquely, the thin flanges 15 and 17 are deformed and the relative angle between the contact member 13 and the switch button 7 is changed. More specifically, when the switch button 7 is pushed obliquely, the contact member 13 is moved down and a part of the contact member 13 abuts one of the contact points. Then, the thin flanges 15 and 17 are deformed so that the bottom face 13*b* of the contact member 13 comes in perfect contact with the contact points.

Air is enclosed in a space surrounded by the inner side wall of the switch button 7, the ceiling of the cavity 11, and the flange 15 formed around the contact member 13. Any vibration generated when the switch button 7 is pushed hard is also absorbed by the enclosed air. Chattering caused by vibration is prevented with more efficiency by the space.

Both the step 11*a* provided at the inner side wall of the switch button 7 and the projection 11*b* provided on the ceiling of the cavity 11 prevent the contact member 13 from being pushed into the deepest portion of the cavity 11 by hard pressing and absorb excessive vibration of the switch button 7. The step 11*a* of the switch button 7 and the shoulder 13*a* formed to fit the step 11*a* keep the relative angle between the contact member 13 and the switch button 7 in an appropriate amount.

The main body of the pushbutton switch 1 is composed of the base plate 3, the flexible portion 5, the switch button 7, all of which are integrally made of an insulating synthetic resin. In manufacturing, the contact member 13 is simply inserted into the cavity 11 of the switch button 7.

Although the switch button 7 of this embodiment is formed in a circular pillar, the switch button 7 can be made of pillars of other shapes such as a rectangular pillar. The contact member, also formed in a circular pillar in this embodiment, can also be a rectangular pillar, or the like, as readily recognized by those skilled in the art.

The two thin flanges 15 and 17 are provided around the peripheral wall of the contact member 13. Yet, the purpose of the thin flanges 15 and 17 is to support the contact member 13 in the cavity 11 of the switch button 7 such that the contact member 13 may be movable in the axial direction of the switch button 7. Therefore, as an alternate approach, the contact member 13 can be provided with a plurality of protrusions on its side walls in place of the single peripheral thin flanges.

Although integrally molded in this embodiment because of the ease of manufacture such molding provides, the thin flanges 15 and 17 and the contact member 13 can be molded separately and fixed to each other after that. In that case, the thin flanges 15 and 17 and the contact member 13 could be made of different materials. For example, the thin flanges 15 and 17 could be plate springs made of metal.

The contact member 13, which is made of conductive synthetic resin in this embodiment, could be made of an insulating synthetic resin with a conductive material can be adhered to or spread on the bottom face 13*b* that contacts the contact points.

It should be understood that, although one specific embodiment of the invention has been shown and described for the purpose of illustration, the invention is not to be limited to the embodiment illustrated and described; but, in its broadest aspects it includes all equivalent embodiments and modifications that come within the scope and spirit of the disclosure and of the appended claims.

Wherefore, having thus described the present invention, what is claimed is:

1. A pushbutton switch for positioning adjacent electrical contacts to be connected comprising:

a) a main body of a resiliently deformable material including a switch button pillar having an internal cavity extending from one open end, said main body having a thin flexible portion provided in communication with a periphery of said open end of said switch button pillar and a base plate connected to a periphery of said flexible portion for supporting said switch button pillar via said flexible portion;

b) a contact member, having a conductive material on least at one exposed surface thereof, disposed in said cavity of said switch button pillar, so that said exposed surface can be positioned adjacent electrical contacts on said base plate; and c) thin resiliently deformable flanges projecting radially outward from sidewalls of said contact member and pressed into an inner sidewall of said switch button pillar so as to support said contact member and to be movable in an axial direction of said switch button pillar.

2. The pushbutton switch of claim 1 wherein:

said flanges comprise at least a pair of peripheral flanges displaced from one another in said axial direction.

3. The pushbutton switch of claim 2 wherein:

said flanges are circumferential flanges.

4. The pushbutton switch of claim 1 comprising:

a central projection on an inner surface of said cavity for contacting and urging said contact member in said axial direction.

5. The pushbutton switch of claim 1 comprising:

a) said switch button pillar having a peripheral step at a middle portion of the inner side wall of said cavity; and, b) said contact member having a shoulder formed to fit and engage said step.

6. The pushbutton switch of claim 1 wherein:

a) said main body is formed of an insulating material; and, b) said contact member is formed of a conducting material.

7. The pushbutton switch of claim 1 wherein:

a) said main body is formed of an insulating material; and, b) said contact member is formed of an insulating material with a conducting material at least on the one exposed surface.

8. A pushbutton switch for positioning adjacent electrical contacts to be connected thereby comprising:

a) a unitary main body of a resiliently deformable material, said main body comprising, a1) a switch button pillar portion having a cavity inside with an open end, a2) a thin flexible portion disposed about a periphery of an outer edge of said switch button pillar portion, and a3) a base plate portion disposed about a periphery of said flexible portion for supporting said switch button pillar portion via said flexible portion;

b) a contact member having a conductive surface disposed in said cavity of said switch button pillar with said conductive surface positioned adjacent a location of the electrical contacts; and, c) thin resiliently deformable flange means projecting radially outward from sidewalls of said contact member and pressed onto an inner sidewall of said switch button pillar portion for supporting said contact member to be movable in an axial direction of said switch button pillar portion.

9. The pushbutton switch of claim 8 wherein:

said flange means comprises at least a pair of peripheral flanges displaced from one another in said axial direction.

10. The pushbutton switch of claim 9 wherein:

said flanges are circumferential flanges.

11. The pushbutton switch of claim 8 comprising:

central projection means on an inner surface of said cavity for contacting and urging said contact member in said axial direction at a central point thereof to allow deformation thereof from oblique pushing of said switch button pillar portion.

12. The pushbutton switch of claim 8 comprising:

a) said switch button pillar portion having a peripheral step at a middle portion of the inner side wall of said cavity; and, b) said contact member having a shoulder formed to fit and engage said step.

13. The pushbutton switch of claim 8 wherein:

a) said main body is formed of an insulating material; and, b) said contact member is formed of a conducting material.

14. The pushbutton switch of claim 8 wherein:

a) said main body is formed of an insulating material; and, b) said contact member is formed of an insulating material with a conducting material on said conductive surface.

15. The pushbutton switch of claim 8 wherein:

a) said switch button pillar portion and said cavity are cylindrical in shape; and, b) said contact member is cylindrical in shape.

16. A pushbutton switch array being positionable adjacent electrical contacts to be connected thereby comprising:

a) a unitary main body of a resiliently deformable material, said main body comprising:

a1) a plurality of adjacent switch button pillar portions, each having an internal cavity extending from one open end, a2) thin flexible portions, each disposed about a periphery of an outer edge of each said switch button pillar portion, and a3) a base plate portion disposed about a periphery of each said flexible portion for supporting each said switch button pillar portion via said flexible portion;

b) a contact member having a conductive surface disposed in each internal cavity of each switch button pillar, said conductive surface being positioned so that it can be placed adjacent a location of the electrical contacts;

c) thin resiliently deformable flange means projecting radially outward from sidewalls of each contact member and pressed onto an inner sidewall of each switch button pillar portion for supporting corresponding contact members to be movable in an axial direction of each switch button pillar portion; and d) communication means connecting each said cavity with an adjacent said cavity for preventing switch sticking by vacuum formation within said cavity.

* * * * *